US007394338B2

(12) United States Patent
Iwakuma et al.

(10) Patent No.: US 7,394,338 B2
(45) Date of Patent: Jul. 1, 2008

(54) SUPERCONDUCTING COIL

(75) Inventors: Masataka Iwakuma, 26-402, Shimoori-Danchi, Ohnojo-Shi, Fukuoka 816-0951 (JP); Akira Tomioka, Yokosuka (JP); Masayuki Konno, Tokyo (JP); Hiroshi Fuji, Tokyo (JP); Kenji Suzuki, Tokyo (JP); Teruo Izumi, Tokyo (JP); Yuh Shiohara, Tokyo (JP); Hidemi Hayashi, Minami-Ku (JP)

(73) Assignees: Masataka Iwakuma (JP); Fuji Electric Systems Co., Ltd. (JP); Fujikura Ltd. (JP); Railway Technical Research Institute (JP); Superconductivity Research Laboratory, International Superconductivity Technology Center, The Juridical Foundation (JP); Kyushu Electric Power Co., Inc. (JP)

( * ) Notice: Subject to any disclaimer, the term of this patent is extended or adjusted under 35 U.S.C. 154(b) by 150 days.

(21) Appl. No.: 11/330,899

(22) Filed: Jan. 12, 2006

(65) Prior Publication Data

US 2006/0238928 A1 Oct. 26, 2006

(30) Foreign Application Priority Data

Jan. 12, 2005 (JP) ..... 2005-005453

(51) Int. Cl.
*H01F 6/00* (2006.01)

(52) U.S. Cl. ..... 335/216; 505/879

(58) Field of Classification Search ..... 335/216; 336/DIG. 1; 505/211, 879, 880

See application file for complete search history.

(56) References Cited

U.S. PATENT DOCUMENTS

2006/0077025 A1 4/2006 Funaki et al.

FOREIGN PATENT DOCUMENTS

JP 07-037444 A 2/1995

(Continued)

OTHER PUBLICATIONS

Iwakuma et al, "Current Distribution In Superconducting Parallel Conductors Wound Into Pancake Coils," IEEE Transactions on Applied Superconductivity, IEEE Service Center, Los Alamitos, CA, US, vol. 10, No. 1, Mar. 2000 (2000-03), pp. 861-864, XP002386537, ISSN: 1051-8223. See the Search Report below for relevance.

(Continued)

*Primary Examiner*—Ramon M. Barrera
(74) *Attorney, Agent, or Firm*—Rossi, Kimms & McDowell, LLP

(57) ABSTRACT

In one embodiment, a superconducting coil includes a tertiary parallel superconductor unit (60) composed of superposed in parallel a plurality of layers of secondary parallel superconductor units (50). The layers of secondary parallel superconductor units include a plurality of superconductor elements (40) arranged in parallel along the axial direction of the coil, forming a superconducting conductor unit. The tertiary parallel superconductor unit is wound on a bobbin (55). In another embodiment, the superconducting coil includes one or more layers of the secondary parallel superconductor unit wound on the bobbin. In both embodiments, the secondary parallel superconductor unit can include at least one non-superconducting conductor element (70). The layer of the secondary parallel superconductor unit forming an outer side of the tertiary parallel superconductor unit can include at least one non-superconducting conductor element. A layer of non-superconducting conducting or high-strength insulating supporting member (71) of electromagnetic force can be formed on the outer side of the tertiary parallel superconductor unit.

14 Claims, 7 Drawing Sheets

FOREIGN PATENT DOCUMENTS

| | | | |
|---|---|---|---|
| JP | 10-172824 | A | 6/1998 |
| JP | 11-273935 | A | 10/1999 |
| JP | 2001-244108 | A | 9/2001 |
| JP | 2004-281503 | A | 10/2004 |
| WO | WO 2005/008687 | A1 | 1/2005 |

OTHER PUBLICATIONS

European Search Report, Jul. 5, 2006, Applicatio No. 06000427.2-2208, corresponding the counterpart European application.

FIG. 6A
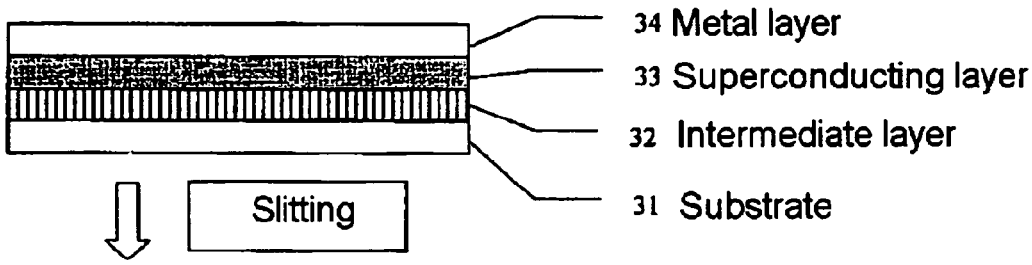
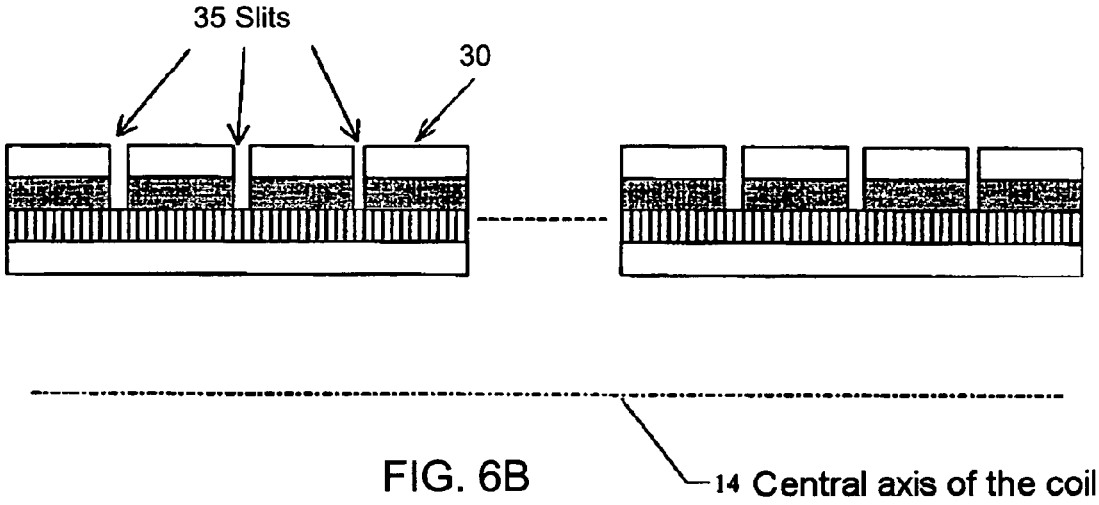
FIG. 6B
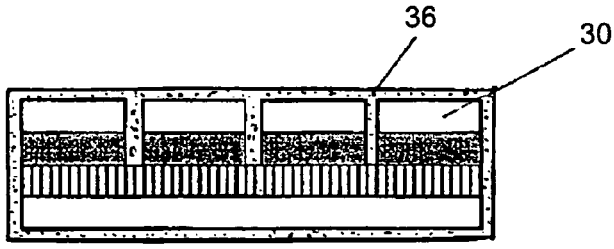
FIG. 6C

SUPERCONDUCTING COIL

BACKGROUND

A superconducting coil has been put to practical use in various fields as a means of generating high magnetic fields. On the other hand, the practical application of superconducting coils to AC devices, such as transformers and reactors, has made little progress due to the phenomenon of losses incurred by superconducting conductors in the presence of AC. However, since the recent development of a superconducting conductor having a small loss of AC by the thinning of superconducting stranded wires, a progress has been made in the researches for its application to transformers and other AC devices, and various proposals have been made on the structure of superconducting coils made thereof.

As superconducting conductors for this case, a superconducting wire made of a metal superconductor that remains in a superconducting state at a very low temperature of 4K at which liquid helium evaporates is mainly used as a practical superconducting material. Recently, however, efforts have been made to develop superconducting coils based on an oxide superconductor. This oxide superconductor is also called "a high-temperature superconductor." This high temperature superconductor is more advantageous than metallic superconductors in terms of a lower operating cost.

When a plurality of conductors are used in parallel in an AC equipment, such as a transformer in which current varies at a high speed, conductors are transposed. The relative positions of a plurality of conductors are changed to reduce the interlinkage magnetic flux between the respective conductors, or to reduce induced voltage resulting therefrom, to thereby make the current distribution for the respective conductors uniform. The differences in induced voltage between respective parallel conductors resulting from the magnetic flux generated by current induces circulating current. In the case of ordinary or non-superconducting conductors, such as copper or aluminum, however, impedance consists mainly of resistance component and the circulating current has a phase deviating by approximately 90° in relation to the load current. For this reason, even if a 30% circulating current is generated, the current flowing in a conductor is the vector sum of 100% of the load current and a 30% circulating current having a phase difference of 90° thereto, and therefore, the absolute value thereof which is the square root of the sum of respective squares amounts to approximately 105%. Thus, the increase in the value of current is small for the circulating current.

When a superconducting wire is used as a conductor, on the other hand, as resistance is practically zero in the superconducting state, impedance that determines circulating current is mostly determined by inductance. Therefore, the circulating current takes the same phase as current, and if the circulating current is 30%, this circulating current is added to the current and as a result a 130% current flows in the superconductor. When this current value reaches the critical current level, however, the loss of AC increases or drift increases.

There exists a critical temperature, a critical current or a critical magnetic field on the superconducting conductor (or superconducting wire) used in the winding of a superconducting coil. In other words, To enable the superconducting wire to maintain the superconducting state, it is necessary to keep the temperature, current, and magnetic field below the specific critical values. When current above the critical current flows in the superconducting wire due to the circulating current, the superconducting wire shifts from the superconducting state to the normal conducting state. In other words, it turns into a normal conductor having resistance. Moreover, the superconducting wire can be damaged by the Joule heat generation. Thus, it is very important to suppress circulating current in a coil consisting of a superconducting wire. For this purpose, transposition is carried out and circulating current is controlled as mentioned earlier. Moreover, the oxide superconducting wire is more vulnerable to bending force than alloy superconductors, and there is an allowable bending radius for displaying its capacity. Therefore, the number of instable points increases as the number of superconductors arranged in parallel increases, in other words as the number of transposed parts increases. Thus, a meticulous care is needed in any transposition work.

The structure of a superconducting coil designed to simplify transposing work and lower costs by reducing transposition parts serving as instable points and suppressing circulating current is disclosed, for example, in Japanese Patent Application Laid Open 11-273935 (pp. 2-4, FIGS. 1-4) (hereafter Reference 1). The summary of the invention described in Reference 1 is as follows: "[I]n a superconducting coil in which a plurality of superconducting wires are arranged in parallel and wound, it is possible to reduce the number of transposition parts, contain the circulating current and at the same time reduce the unstable parts by adopting a structure in which the relative positions are changed only at the ends of coil, and in addition by making the number of coil layers an integral multiple of 4 times the number of superconducting wires arranged in parallel (4 times the number of wires). As a result, the work and time for transposition is reduced resulting not only in lower costs, but also fewer unstable parts and thus enabling to contain circulating current. Therefore, it is possible to obtain an advantage of being able to excite and demagnetize at a high speed and stably".

FIG. 7 is an example of the transposition structure of a superconducting coil described in FIG. 1 of Reference 1. In FIG. 7, for winding three superconducting wires 3*a* superposed in the radial direction of the coil by winding in the direction of bobbin 1*a*-bobbin 1*b*, at the start of the coil on the 1*a* side of the bobbin, the superconducting wires 3*a* are wound for multiple layers and from the internal diameter of the coil, for example, in the order of A1, A2, and A3 (not shown), and at the transposition part 2*b* at the end of the coil, at first A3 is bent at the following turn, and the transposition work is carried out on A2 and A1 in the same manner, so that at the end of the coil on the 1*b* side of the bobbin, the coil will be arranged for example in the order of A3, A2, and A1. By arranging the same as described above, the number of transposition parts and bending of coil will be reduced in comparison with the prior transposition structure described in FIG. 4 of Reference 1, and the work will be considerably simplified thereby. Regarding an example of the structure mentioned above on a number of coil layers equal to an integral multiple of four times the number of superconducting wires arranged in parallel (4 times the number of wires), the description is omitted here. See Reference 1 for details.

The adoption of a transposition structure as described in Reference 1 will enable the inductance and current distribution for the respective superconducting wires constituting the conductor to be uniform. This will increase the current capacity by increasing the number of superconducting wires arranged in parallel and to eliminate additional losses due to the increased number of superconducting wires in parallel.

The following will describe the oxide superconducting wire material (high temperature superconducting wire). One of possible preferable high-productivity methods of producing high-temperature superconductor elements is, for example, that of forming a film of oxide superconducting material on a flexible tape substrate. Production methods based on the vapor phase deposition method, such as laser ablation method, CVD method, etc., are now being developed. Oxide superconducting wires made by forming an oxide superconducting film on the tape substrate as described above have an exposed superconducting film on the outermost layer, and no stabilization treatment has been applied on the surface of the exposed side. As a result, when a relatively strong current is applied to such an oxide superconducting wire, the superconducting film transits locally from the superconducting state to the normal conducting state due to the local generation of heat, resulting in an unstable transmission of current.

For the purpose of solving the problems mentioned above, and providing an oxide superconductor having a high critical current value, capable of transmitting current with stability and whose stability does not deteriorate even after an extended period of storage and the method of producing the same, Japanese Patent Application Laid Open 7-37444 (pp. 2-7, FIG. 1) (hereafter Reference 2) discloses the following tape-shaped superconducting wire: "[A] superconducting wire comprises of an intermediate layer formed on a flexible tape substrate, an oxide superconducting film formed on the intermediate layer, and a gold or silver film (a metal normal conduction layer) 0.5 μm or more thick formed on the oxide superconducting film." And example of embodiment described in Reference 2 reads as follows: "On 'Hastelloy' tape serving as the substrate, an yttria stabilized zirconia layer or magnesium oxide layer is formed as an intermediate layer. On top of this layer, Y—Ba—Cu—O oxide superconducting film is formed. And on this layer, a gold or silver coating film is formed." However, when mass-produced tape-shaped superconducting wires like the ones described in References 2 are used in an AC device, the AC loss that develops in the superconducting wires will be, due to the form anisotropy of flat tapes, dominated by those in the perpendicular magnetic field acting in the perpendicular direction upon the flat surface of the tape, and thus the AC losses increase. In addition, there is a problem with regard to the transposition structure. To solve these problems, some of the inventors of the present application have disclosed the following superconducting wire materials and a superconducting coil based on the same materials in a related application PCT/JP2004/009965, corresponding to U.S. patent application Ser. No. 10/514,194, the disclosure of which is incorporated herein by reference.

FIGS. 6A, 6B, and 6C show a superconducting wire material disclosed in FIG. 1 of the international application mentioned above. Specifically, the international application has been contemplated for "providing a superconducting wire capable of suppressing AC loss and a low-loss superconducting coil made from this superconducting wire having a simple structure without transposition, capable of canceling interlinkage magnetic flux due to the perpendicular magnetic field to the wire, and capable of suppressing the circulating current within the wire due to the perpendicular magnetic field and making shunt current uniform so that the losses may be limited." The international application, as shown in FIGS. 6A, 6B, and 6C further discloses the following: "[A] simple coil structure without transposition wherein a superconducting film formed on the substrate 31 is transformed into a tape to make a superconducting wire material, the superconducting film part constituting at least a superconducting layer 33 is slit to form slits 35 and to separate electrically the same into a plurality of superconducting film parts respectively having a rectangular section and arranged in parallel to form parallel conductors, in other words parallel conductors constituted by arranging a plurality of element conductors, and the superconducting coil constituted by winding the superconducting wire material has, in view of the structure or arrangement of the superconducting coil, a coil structure containing at least partially a part wherein the perpendicular interlinkage magnetic flux acting among various conductor elements 30 of the parallel conductors by the distribution of the magnetic field generated by the superconducting coils acts to cancel each other is provided."

In FIGS. 6A, 6B, and 6C, the group number 30 represents a conductor element composed of split parts of a metal layer and a superconducting layer, and 32 represents an intermediate layer, 34 represents a metal layer, 35 represents a slit as splitting groove, and 36 represents an electric insulating material. The superconductor before splitting shown in FIG. 6A consists of, for example, Hastelloy tape for the substrate 31, on which the intermediate layer 32 is formed as an electric insulation layer, on which Y—Ba—Cu—O oxide superconducting film is formed as a superconducting layer 33, and on which, for example, a gold or silver coating layer is formed as a normal or non-superconducting conducting metal layer 34. Incidentally, as the intermediate layer 32 described above, a double-layered structure consisting of, for example, a cerium oxide ($CeO_2$) layer formed on a gadolinium zirconium oxide ($Gd_2Zr_2O_7$) layer is formed. The metal layer 34, however, need not be formed.

The superconducting conductor is, as shown in FIG. 6B, slit in the longitudinal direction of the superconducting conductor, and as shown in FIG. 6C epoxy resin, enamel, and other flexible electric insulation materials 36 are filled in the grooves formed by slitting and over the entire environment around the conductors to form parallel conductors. In applying the superconducting wires as described above to the superconducting coil, the superconducting wires consisting of the parallel conductors are, as shown in FIG. 6B, wound in the form of a cylindrical layer on the peripheral surface of a cylindrical bobbin made of an electrical insulation material not shown around the central axis of coil 14.

The superconducting wire material shown in FIGS. 6A, 6B, and 6C above functions as a multi-filament superconductor, enables to uniformize the sharing of current, and to reduce the magnetic field applied at right angles to the superconductor elements, to reduce AC losses by dividing the superconducting film part into a plurality and arranging them electrically in parallel.

In addition, the international application described above further discloses a preferable structure of superconducting coil to which the superconducting wire materials shown in FIGS. 6A, 6B, and 6C above are applied. Specifically, the international application states: "The superconducting coil constituted by winding the superconducting wire material has, in view of the structure or arrangement of the superconducting coil, a coil structure containing at least partially a part wherein the perpendicular interlinkage magnetic flux acting among various conductor elements of the parallel conductors by the distribution of the magnetic field generated by the superconducting coils acts to cancel each other is provided. This will provide a superconducting wire capable of suppressing AC loss and a low-loss superconducting coil made from this superconducting wire having a simple structure without transposition, capable of canceling interlinkage magnetic flux due to the perpendicular magnetic field to the wire, and capable of suppressing the circulating current within the wire due to the perpendicular magnetic field and making shunt current uniform so that the losses may be limited." See the international application mentioned above for details.

The following will now describe the measures against over-current in the event of short-circuit of a transformer. When a transformer is short-circuited, strong short-circuit current flows in the coil and an excessive electromagnetic force works. In the case of a superconducting transformer, current density is higher than that of a normal conductive transformer. In other words, for a same current capacity, the superconducting transformer has a smaller conductor section. Therefore, when a same electromagnetic force works on the conductor, the superconducting transformer applies a larger stress to the conductor. In the case of an oxide superconducting transformer, the conductor, being an oxide, has a relatively low mechanical strength, and may not be able to withstand this electromagnetic force at the time of over-current.

The means for solving this problem is disclosed in Japanese Patent Application Laid Open 2001-244108 (hereafter Reference 3). The following is a citation of a summary contained in Reference 3: "On a superconducting coil constituted by winding a taped-shaped superconducting wire material along a spiral groove formed on the outer periphery of a cylindrical insulating bobbin, a metal tape wherein normal conductors such as copper, copper alloy, titanium, stainless steel and the like are used is lap wound on the outer periphery of the superconducting wire material mentioned above, the metal tape is bound by hardening the resin used, and then the metal tape is connected electrically in parallel with the superconducting wire material. This structure will enable to support the electromagnetic force in the radius direction applied to the superconducting wire material by the metal tape from the outer periphery in the event of a short-circuit, and to prevent possible burn-out of the coil due to a sharp rise in temperature by diverting a part of current to the metal tape when the superconducting wire material transformed into a normal conductor because of Joule generation of heat resulting from an over-current."

The critical current of high-productivity tape-shaped superconducting wire materials such as those described in Reference 2 or the international application mentioned above is approximately 100 A in the self-magnetic field and at the liquid nitrogen temperature (77K). Under the superconducting coil state, the critical current falls down further due to the generation of the magnetic field, and the current usable for equipment falls down substantially from the critical current 100 A mentioned above. On the other hand, the required current capacity is varied according to the equipment used or usage. When a strong current is required as in the case of the low-voltage winding of a transformer for example, it is possible that the application described in Reference 2 or the international application mentioned above may be insufficient to cope with the situation.

Furthermore, at the time of starting excitation or in the event of an unexpected short-circuit for example, so-called measures against over-current may be required so that the AC equipment can withstand a current in excess of the rated current for a short period. On the tape-shaped superconductor elements described in Reference 2 or the international applications mentioned above, a metal layer consisting of gold or silver is formed as a stabilizing layer as described above. This metal layer is formed mainly for the purpose of improving superconductive performance. This metal layer, however, is generally 10 μm thick or less, making it too thin, and often insufficient to rely on as a safety measure against over-current.

Accordingly, there still remains a need to reduce AC losses, to increase the current capacity of coils, to prevent the burn-out of conductors due to over-current at the time of starting excitation or in the unexpected event of short-circuit by using parallel superconducting conductors and to provide a safe large-capacity superconducting coil. The present invention addresses this need.

SUMMARY OF THE INVENTION

The present invention relates to a superconducting coil, such as used in electric machinery and apparatuses in which current changes rapidly, for example storage of energy, magnetic field application, electric transformers, reactors, current limiters, motors, electric generators and the like.

According to one aspect of the invention, the superconducting coil includes a coil structure composed of one or more layers of a wound secondary parallel superconductor unit composed of a plurality of superconductor elements arranged parallel in an axial direction of the coil structure. The coil structure is configured to cancel any perpendicular interlinkage magnetic flux acting among various superconductor elements of the secondary parallel superconductor unit by the distribution of the magnetic field generated by the superconducting coil.

According to another aspect of the invention, the superconducting coil includes a coil structure composed of one or more layers of a wound tertiary parallel superconductor unit composed of a plurality of parallel layers of secondary parallel superconductor units. Each of the secondary parallel superconductor units is composed of a plurality of superconductor elements arranged parallel in the axial direction of the coil structure. The coil structure is configured to cancel any perpendicular interlinkage magnetic flux acting among various superconductor elements of the secondary parallel superconductor units by the distribution of the magnetic field generated by the superconducting coil.

Each of the superconductor elements can comprise a substrate and a superconductor layer formed on the substrate, electrically separated into a plurality of superconductors and arranged in parallel. Each of the superconductor elements can further include an intermediate layer for electric insulation formed between the substrate and the superconductor layer. Each of the superconductor elements can further include a metal layer formed on the superconductor layer. The metal layer can be electrically separated and arranged in parallel like the superconductor layer.

Each of the secondary parallel superconductor units can include at least one non-superconducting conductor element. A layer of the secondary parallel superconductor unit forming an outer side of the tertiary parallel superconductor unit can include at least one non-superconducting conductor element. The at least one non-superconducting conductor element need not be transposed. The coil structure can further include a layer of non-superconducting conducting or high-strength insulating supporting member of electromagnetic force in an outer side of the tertiary parallel superconductor unit. The layers of the second parallel superconductor units can be transposed. When a metal material layer is chosen for its substrate, the substrate functions as a stabilizing material, and the metal layer can also serve as a stabilizing material.

BRIEF DESCRIPTION OF THE DRAWINGS

FIGS. 6A, 6B, and 6C illustrate the structure of the superconductor disclosed in PCT/JP2004/009965.

DETAILED DESCRIPTION

Figure 1:
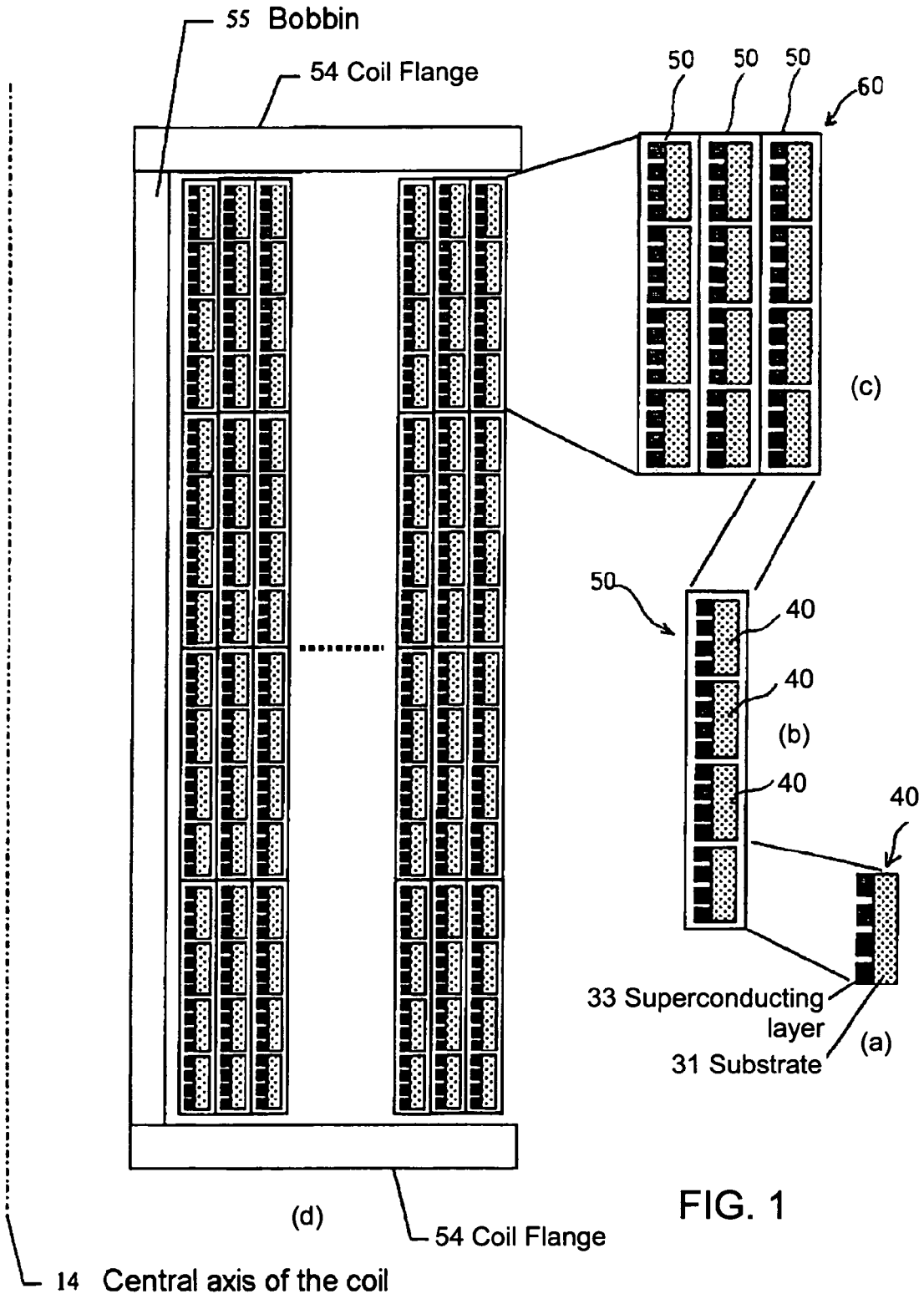
FIG. 1 schematically illustrates a sectional view of one embodiment of a superconducting coil according to the present invention.

Referring to FIG. 1, which schematically illustrates a sectional view of one embodiment of a superconducting coil, section (a) shows a superconductor element 40 having a plurality of electrically separated and parallel superconducting layers 33 formed on a substrate 31. This superconductor element 40 can be composed of a substrate, an intermediate layer, a superconducting layer, a metal layer and the like, similarly as shown in FIGS. 6A, 6B, and 6C. The metal layer mentioned above, however, can be omitted. As shown in section (a), the superconductor element can be composed of a substrate 31 and a superconducting layer 33 electrically separated into a plurality of parallel superconductors, or a plurality of electrically separated superconducting layers. In addition, a single superconducting layer not electrically separated can be formed on the substrate. The electrical insulating material 36 shown in FIG. 6C is omitted in section (a).

Still referring to FIG. 1, section (b) shows four superconductor elements 40 shown in section (a) arranged in parallel along the axial direction of the coil. In this embodiment, the four superconducting elements 40 constitute a secondary parallel superconductor unit 50. The four superconductor elements 40, i.e., the secondary parallel superconductor unit 50, shown in section (b) are respectively electrically insulated. In section (b), as the inductance of each superconductor element 40 arranged in parallel is the same, it is not necessary to transpose superconductor elements 40 in the secondary parallel superconductor 50. As a result, the secondary parallel superconductor 50 will be equivalent to a conductor having a current capacity equal to the multiple of the number of superconductor elements 40 arranged in parallel.

Still referring to FIG. 1, section (c) shows the tertiary parallel superconductor unit 60 composed of three layers of secondary parallel superconductor units 50 arranged parallel to each other to constitute a superconducting conductor. The secondary parallel superconductor units 50 are electrically insulated among themselves. As the inductance among the secondary parallel superconductor units 50 laid one on another is different due to their position in the coil radius direction, it is desirable to transpose. As this transposition structure, the adoption of a transposition structure described in Reference 1, or the structure of transposing at the ends in the coil axis direction can equalize the inductance of superconductor elements constituting the conductors, to uniformize the sharing of current, and to prevent the current density for the coil from decreasing. The details will be described below.

Still referring to FIG. 1, section (d) is a schematic sectional view of a coil structure composed of winding a plurality of layers of the tertiary parallel superconductor unit 60 in the coil radius direction and winding for a plurality of turns around the coil axis. In section (d), the number of layers is omitted and shown by a broken line. Reference number 54 represents a coil flange and reference 55 represents a bobbin. The bobbin 55 need not to be cylindrical as shown in the figure, and can take the form of a racing track, i.e., oval, a rectangle with rounded corners or various other forms.

The structure of the superconducting coil as shown in FIG. 1 can secure a current capacity equivalent to three layers X four superconductor elements 40, or a current capacity of 12 times. For realizing a large current capacity, it will be easier to manufacture and less costly to adopt the structure shown in FIG. 1 using a larger number of smaller current-capacity and parallel conductor elements in comparison with superconductor elements having a large current capacity for the conductor element.

As the perpendicular interlinkage magnetic flux acting on the electrically separated secondary parallel superconductor units 50, and the superconductor elements 40 constituting the same, as well as the electrically separated superconducting layers 33, acts to cancel each other as the whole superconducting materials based on the symmetry in the axis direction of the superconducting coil as similarly disclosed in the international application mentioned above, AC losses based on the perpendicular magnetic field can be suppressed. In addition, as the split superconducting layer 33 can behave as independent filaments, further reduction of AC losses is possible.

Figure 2:
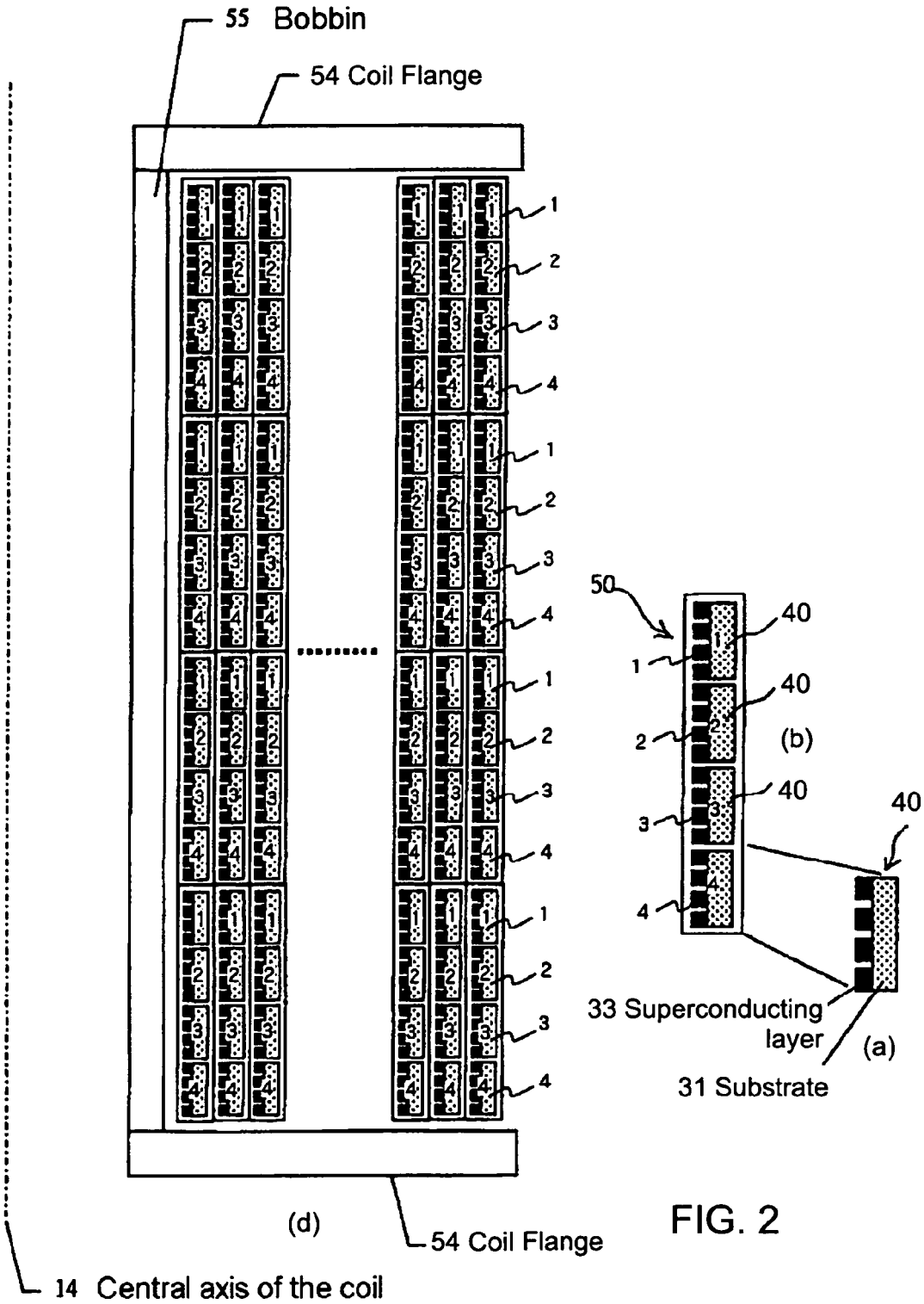
FIG. 2 schematically illustrates a sectional view of another embodiment of a superconducting coil according to the present invention.

Referring to FIG. 2, which illustrates another embodiment, the superconducting coil is made by winding a single layer or a plurality of layers of secondary parallel superconductor units 50 constituted by arranging a plurality of superconductor element 40 in parallel in the coil axis direction, as described for the embodiment of FIG. 1. In this case also, based on the symmetry of the superconducting coil in the axis direction, the perpendicular interlinkage magnetic flux acting among various superconductor elements of the secondary parallel superconductor unit 50 acts to cancel each other due to the distribution of magnetic field generated by the superconducting coil.

In FIG. 2, each superconductor element 40 is marked by numbers 1-4 for the sake of convenience of description. In the case of the superconducting coil of the embodiment shown in FIG. 2, it is not necessary to transpose the secondary parallel superconductor units 50. Therefore, the superconductor elements 40 within all the secondary parallel superconductor units 50 are numbered in the axis direction as shown by the columns of (1, 2, 3, 4), (1, 2, 3, 4), . . . (1, 2, 3, 4), and the columns of superconductors are wound in such a way that this column can be repeated along the layer direction. In the embodiment of FIG. 1, however, it is preferable to transpose the secondary parallel superconductor units 50, which will describe in reference to FIG. 4 below.

Figure 3:
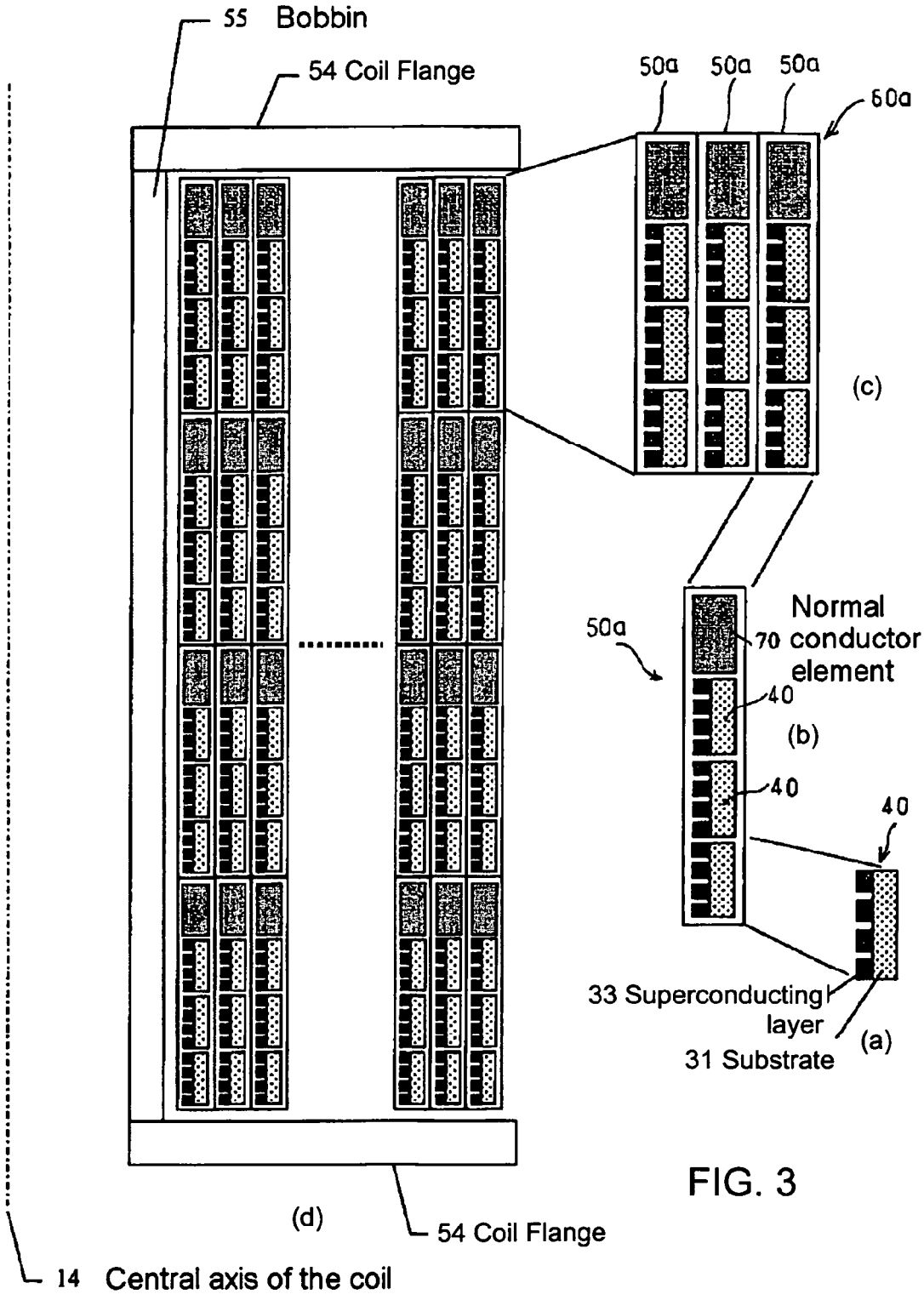
FIG. 3 schematically illustrates a sectional view of yet another embodiment of a superconducting coil according to the present invention.

The embodiment of FIG. 3 is similar to the embodiment of FIG. 1, except that it includes means for protecting against over-current. Specifically, in the embodiment of FIG. 3, each of the secondary parallel superconductor units 50*a* includes at least one normal or non-superconducting conductor element 70 made of a normal or non-superconducting conductor material as a measure against over-current. More specifically, at least one of the superconductor elements 40 of each of the secondary parallel superconductor units 50*a* is replaced with a normal or non-superconducting conductor element 70 made of a normal or non-superconducting conductor material. In the embodiment of FIG. 3, the secondary parallel superconductor unit is represented by 50*a*, and the tertiary parallel superconductor unit is represented by 60*a*. Other materials are similar to those in FIG. 1.

Still referring to FIG. 3, section (a) 3 shows the superconductor element 40 similar to that shown in section (a) of FIG. 1. For arranging this in the axis direction of the superconducting coil as shown in section (b) of FIG. 3, the secondary parallel superconductor 50*a* is constituted by including at least one normal conductor element 70 instead of constituting the same entirely of superconductor elements 40. The inductance among the conductor elements laid out is same as described above. The normal conductor element 70 is always accompanied by an electric resistance, while the superconductor element 40 composed of a superconductor is in normal condition free of concern over a negligibly small electric resistance. Therefore, current flows in the superconductor element 40, and there is no Joule generation of heat in the normal conductor element 70 and there is no increase in losses due to the disposition of the normal conductor elements. Moreover, the normal conductor element 70 can take the form of tape-shaped conductor or conductor consisting of a strand.

Still referring to FIG. 3, section (c) shows the tertiary parallel superconductor unit 60*a* turned into a conductor by aligning or stacking three layers of secondary parallel superconductor units 50*a*. This tertiary parallel superconductor unit 60*a* is wound for four turns per layer to constitute a coil in the same way as FIG. 1. See section (d) of FIG. 3. The number of layers is omitted. Current normally flows in the superconductor elements 40. However, when over-current flows, such as at the start of excitation of a transformer, current flows in excess of the critical current in the superconductor elements 40. When the critical current is exceeded, an electric resistance develops in the superconductor elements 40. Depending on the relationship between the electric resistance of the superconductor elements 40 in this case and the electric resistance of the normal conductor elements 70, current flowing in each of the conductor elements is determined.

It is known that the so-called degradation of critical current occurs where the critical current after switching on drops when over-current flows in excess of a specified multiplying factor of the initial critical current (a multiplying factor different depending on the wire material), although the critical current after switching on does not drop even if over-current flows until the specified multiplying factor of the initial critical current is reached. According to the present invention, as it is possible to share current at the time of over-current with a normal or non-superconducting conductor element 70 by setting adequately the electric resistance of the superconductor element 40 and the electric resistance of the normal or non-superconducting conductor element 70, it is possible to reduce current flowing through the superconductor elements 40, to suppress the degradation of the critical current of the superconductor elements 40.

Figure 4:
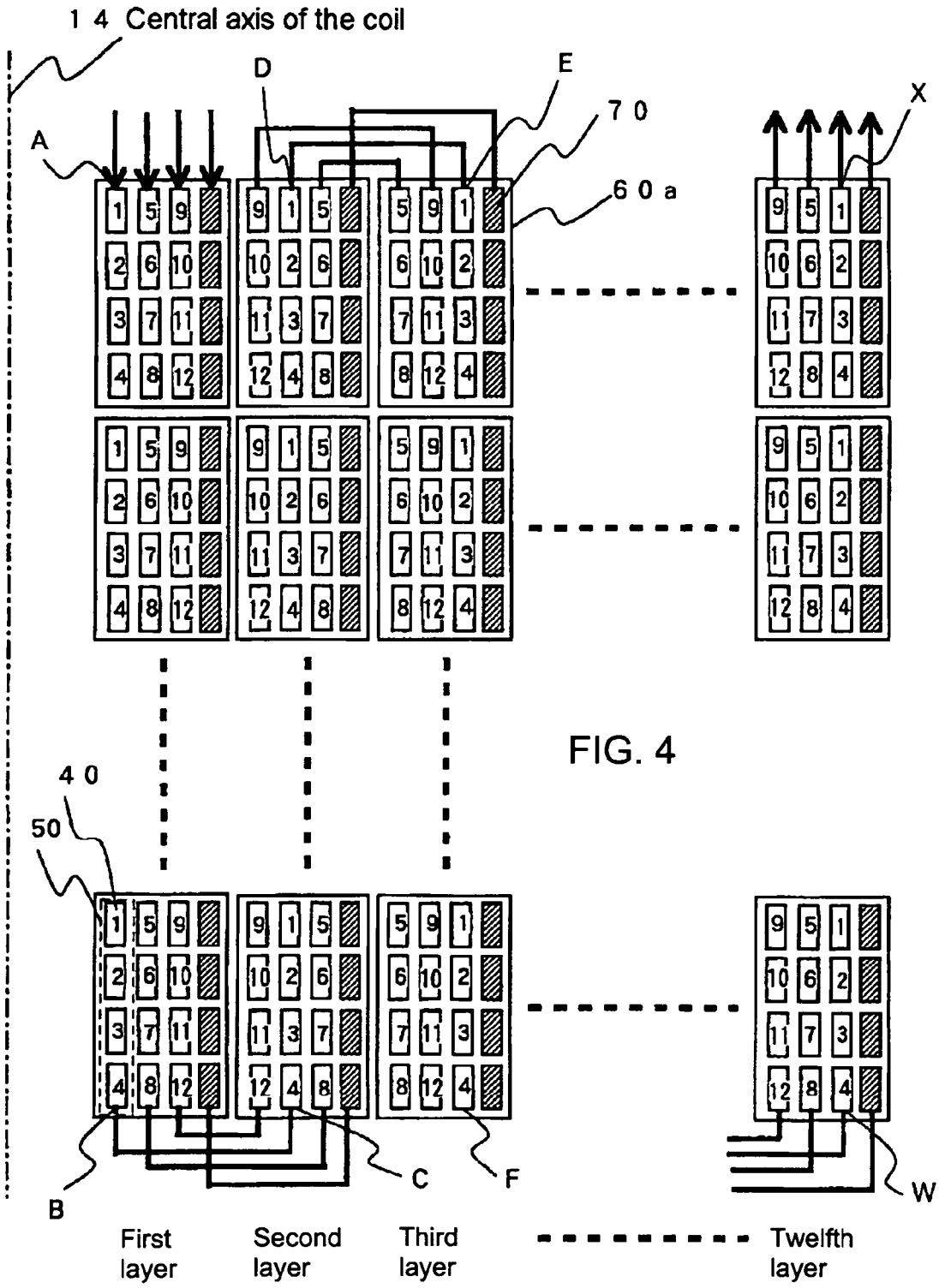
FIG. 4 schematically illustrates a transposition structure of yet another an embodiment of a superconducting coil according to the present invention.

Referring to FIG. 4, which shows a simplified embodiment of a superconducting coil in order to describe the transposition structure thereof, the superconducting coil is made by winding the tertiary parallel superconductor units 60*a* constituted by putting together in the radius direction three layers of the secondary parallel superconductor units 50 constituted by arranging in parallel in the coil axis direction four superconductor elements 40 and disposing normal or non-superconducting conductor elements 70 on the outermost layer as a conductor unit.

For transposing, as described above, the structure of "making the number of coil layers an integral multiple of four times the number of superconductor elements arranged in parallel (4 times the number of superconductor elements)" is preferable. Therefore, in FIG. 4, an embodiment adopting 3 superconductors (secondary parallel superconductors)×4=12 layers is shown, and in the lower section of FIG. 4, various layers starting with layer 1, layer 2 . . . and ending with layer 12 are shown. The superconductor elements 40 are numbered 1 to 12 for the sake of convenience of description.

When the tertiary parallel superconductors 60*a* are superposed for their disposition as shown in FIG. 4, the inductance among the secondary parallel superconductors changes in the same way as FIG. 1, and therefore it is necessary to transpose at least the superconductor elements 40 among layers. Their transposition equalizes the inductance among the secondary parallel superconductors. Even if the normal conductor elements are not transposed, and depending on the material and temperature of the normal conductor material, the number of layers superposed and the frequency of operation, current flowing in the normal conductor element is normally limited by resistance, and the generation of heat often would not matter. Therefore, in FIG. 4, a structure not providing for transposition is shown among normal conductor elements 70 corresponding to the secondary parallel superconductor units. When required to transpose, however, the required transposition will be carried out among the tertiary parallel superconductor units.

In FIG. 4, current for the conductor element flows in from the top left side of the figure along the large arrows and flows out from the right top side of the figure, and during that time various superconductor elements 40 transpose successively as shown by the heavy line between the upper and lower layers of the figure of the tertiary parallel superconductor units 60*a*. For example, the secondary parallel superconductor nearest to the central axis of the coil numbered 1-4 among the three layers of the tertiary parallel superconductor unit 60*a* nearest to the central axis of the coil 14 are introduced at the position A shown at the top left side of the figure, and passes through the points B, C, D, E, F . . . W shown in the figure and exit from the position X shown at the top right side of the figure, and the implementation of transposition as shown above equalizes the inductance among the secondary parallel superconductors.

Figure 5:
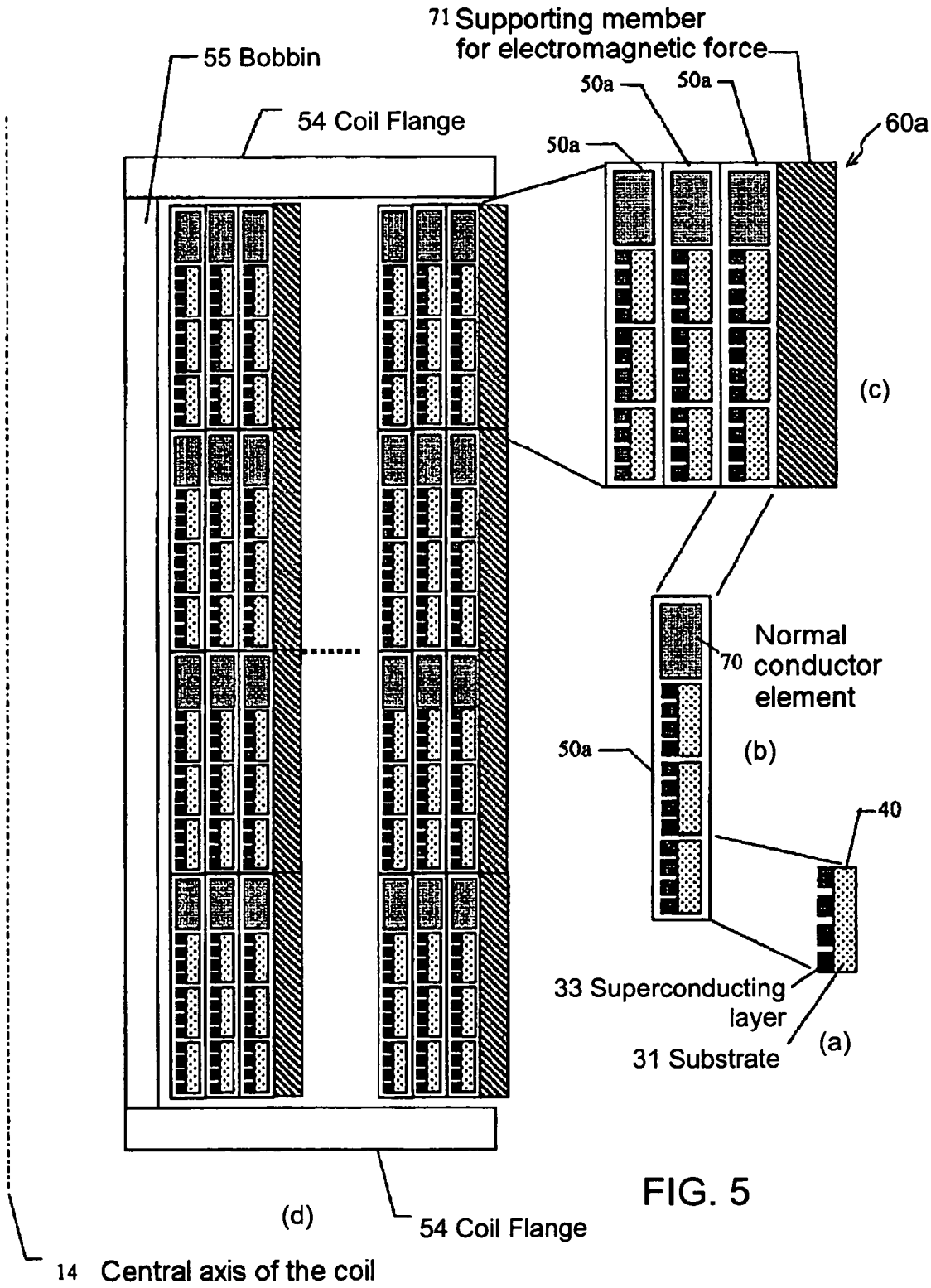
FIG. 5. schematically illustrates a sectional view of yet another embodiment of a superconducting coil according to the present invention.
Figure 7:
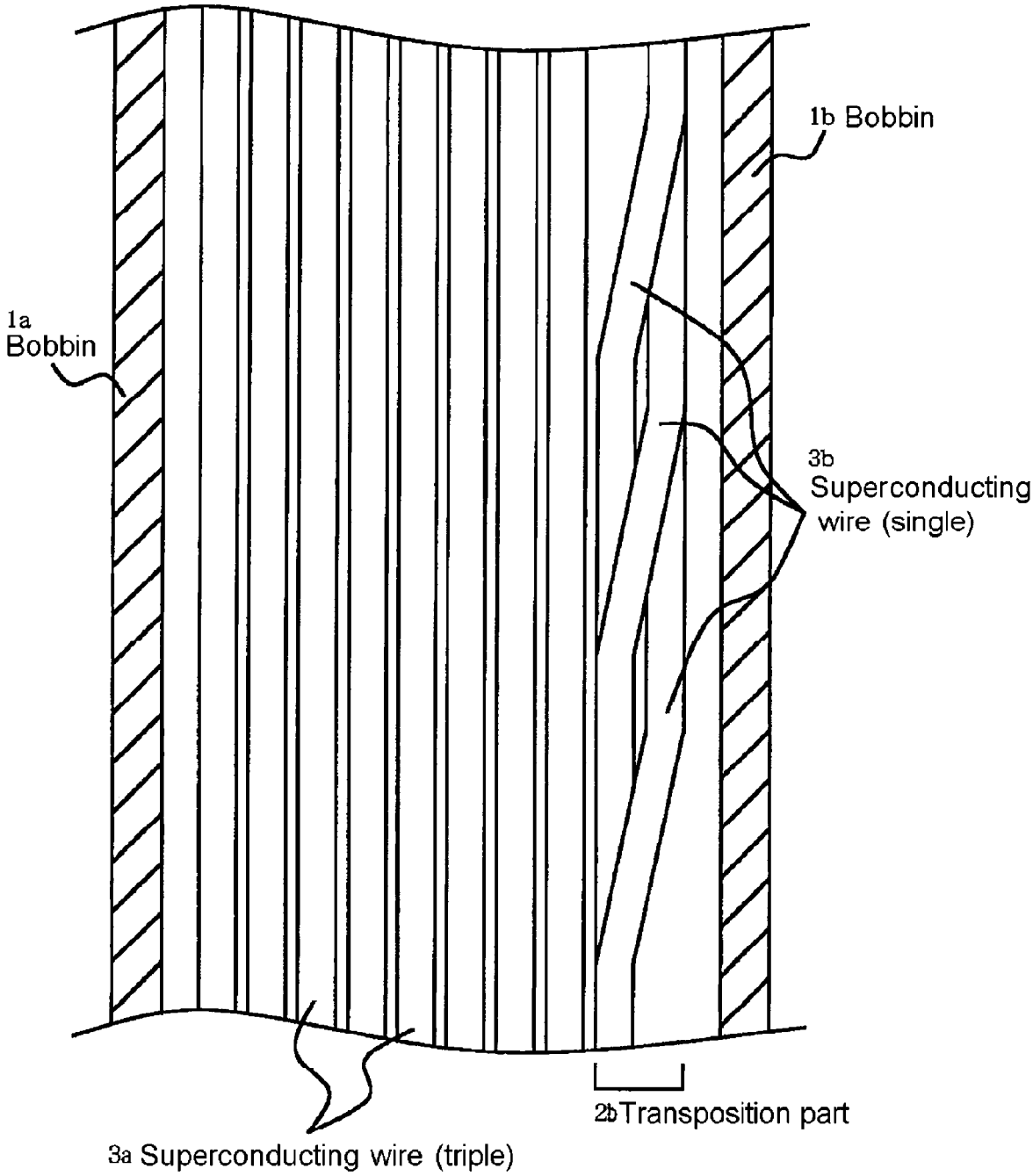
FIG. 7 (Prior Art)
FIG. 7 illustrates an example of the transposition structure of the superconducting coil disclosed in Reference 1.

FIG. 5 is similar to the embodiment of FIG. 3, except that it further includes a normal or non-superconducting conductor or insulating support element 71 on the outermost layer similar to the embodiment of FIG. 4. The outermost layer of the secondary parallel superconductor unit 50*a* forming the tertiary parallel superconductor unit 60*a* includes the supporting member 71 of electromagnetic force composed of normal or non-superconducting conducting material or high-strength insulating material. Sections (a) and (b) of FIG. 5 are identical to sections (a) and (b) of FIG. 3. Thus, their descriptions are omitted. Section (c) of FIG. 5 shows the tertiary parallel superconductors 60*a* constituted by superposing the supporting member 71 for electromagnetic force composed of a normal conducting material on a conductor constituted by superposing three layers of the secondary parallel superconductor units 50*a*. Section (d) of FIG. 5 shows a coil formed by winding a plurality of turns of the tertiary parallel superconductors shown in section (c) of FIG. 5. The supporting member 71 for electromagnetic force can be split into four parts in the coil axis direction in the same way as shown in FIG. 4. The effects of the normal conductor element 70, being identical with that of FIG. 3 mentioned above, is omitted here.

The superconducting coil as shown in FIG. 5 can withstand a strong electromagnetic force. As the material for this mechanical supporting member 71, stainless steel and other high-strength metal materials can be used. When the electromagnetic supporting function alone is assigned to the supporting member 71 for electromagnetic force, and when the stabilizing function is assigned to the normal conductor elements 70, glass tape and other high-strength insulating materials can be adopted as the material of the mechanical supporting member 71.

The embodiments identified above can operate as a solenoid coil as an example. However, in addition to the solenoid coil, the present invention can be applied to other parts, such as a pancake coil, saddle-shaped coil used mainly in superconducting rotary machines and other superconducting coils.

According to the present invention, it is possible to suppress AC losses, to increase the current capacity of the coil by using parallel superconductors, and to prevent the burn-out of conductors due to over-current at the start of excitation or in an unexpected event of short-circuit, and to provide a safe and large capacity superconducting coil. The tertiary parallel superconductors described above can function as conductors having multiple filaments by having a large number of electrically separated superconductor elements arranged in a secondary parallel superconductor unit, making it easy to wind a large current capacity superconducting coil. It is now possible to uniformize the sharing of current and to reduce AC losses at the same time. And from the viewpoint of the structure of the coil, AC losses based on the perpendicular magnetic field can be reduced based on the coil structure configured to cancel each other the perpendicular interlinkage magnetic flux working among various superconductor elements of the secondary parallel superconductor units. In this case, the transposition among superconductor elements in the coil axis direction is useless, and the structure can be simplified for increasing the current capacity by arranging the superconductors in parallel.

The present invention can prevent burn-out due to Joule generation of heat by diverting current to a normal conductor when the superconductor element materials fall into the state of resistance due to over-current at the start of excitation or in the unexpected event of a short-circuit. The inductance of superconductor elements constituting the secondary parallel superconductor unit can be equalized by having them arranged in the coil axis direction and will be nearly the same between the superconductor elements and the normal conductor elements. On the other hand, the normal conductor elements present electrical resistance while the superconductor elements present a negligibly small electrical resistance within the range of normal use. Therefore, the impedance of normal conductor elements will be greater than that of superconductor elements, and most of current flows in superconductor elements and there is practically no heat generated by the current flowing in normal conductor elements. This relationship exists in a superconducting coil when the secondary parallel superconductor unit includes normal or non-superconducting conductor elements. Therefore, losses resulting from the parallel arrangement of normal conductor elements are negligibly small. When over-current flows in superconductor elements in excess of the critical current, however, there appears electrical resistance due to a magnetic flux flow. Due to the relationship between the electrical resistance of superconductor elements and the electrical resistance of normal conductor elements, current flows even in normal conductor elements. Therefore, due to the possibility of flowing current in normal conductor elements, the flow of excessive current in superconductor elements can be prevented. As a result, it is possible to provide a superconducting coil presenting no degradation of property even when an over-current occurs in excess of the rated current.

The position of replacing superconductor elements by normal conductor elements is not limited to one but extends to, for example, all the top positions or the bottom positions in the coil axis direction of the tertiary parallel superconductors. Or the entire layer in the coil layer direction can be chosen. From the viewpoint of supporting electromagnetic force at the time of over-current, however, it is preferable to let normal conductor elements to play the dual functions of sharing current and supporting electromagnetic force. As the materials for normal or non-superconducting conductor elements, copper, copper alloys, titanium, stainless steel, and other normal conducting materials can be used. Although this may depend on the coil specification, when an importance is attached to the support for electromagnetic force, it is preferable to use materials having a high mechanical strength even if their electrical conductivity is relatively low. Depending on the situation, it is possible to combine a material having a high electrical conductivity and a material having a high mechanical strength.

From the viewpoint of attaching importance to the support of electro-magnetic force at the time of over-current, the secondary parallel superconductor unit in the outer layer of the tertiary parallel superconductor can be made of supporting members of electromagnetic force composed of normal conducting materials or high-strength insulating materials.

While the present invention has been particularly shown and described with reference to particular embodiments, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priority to, Japanese Application No. 2005-005453, filed on 12 Jan. 2005. The disclosure of the priority application, in its entirety, including the drawings, claims, and the specification thereof, is incorporated herein by reference.

What is claimed is:

1. A superconducting coil comprising:

a coil structure composed of one or more layers of a wound tertiary parallel superconductor unit composed of a plurality of parallel layers of secondary parallel superconductor units, wherein each of the secondary parallel superconductor units is composed of a plurality of superconductor elements arranged parallel in an axial direction of the coil structure, and wherein the coil structure is configured to cancel any perpendicular interlinkage magnetic flux acting among various superconductor elements of the secondary parallel superconductor units by the distribution of the magnetic field generated by the superconducting coil.

2. A superconducting coil according to claim 1, wherein each of the superconductor elements comprises a substrate and a superconductor layer formed on the substrate, electrically separated into a plurality of superconductors and arranged in parallel.

3. A superconducting coil according to claim 2, wherein each of the superconductor elements further includes an intermediate layer for electric insulation formed between the substrate and the superconductor layer.

4. A superconducting coil according to claim 3, wherein each of the superconductor elements further includes a metal layer formed on the superconductor layer, the metal layer being electrically separated and arranged in parallel.

5. A superconducting coil according to claim 1, wherein each of the secondary parallel superconductor unit includes at least one non-superconducting conductor element.

6. A superconducting coil according to claim 1, wherein a layer of the secondary parallel superconductor unit forming an outer side of the tertiary parallel superconductor unit includes at least one non-superconducting conductor element.

7. A superconducting coil according to claim 6, wherein the at least one non-superconducting conductor element is not transposed.

8. A superconducting coil according to claim 1, wherein the coil structure further includes a layer of non-superconducting conducting or high-strength insulating supporting member of electromagnetic force in an outer side of the tertiary parallel superconductor unit.

9. A superconducting coil according to claim 5, wherein the coil structure further includes a layer of non-superconducting conducting or high-strength insulating supporting member of electromagnetic force in an outer side of the tertiary parallel superconductor unit.

10. A superconducting coil according to claim 1, wherein the layers of the second parallel superconductor units are transposed.

11. A superconducting coil comprising:

a coil structure composed of one or more layers of a wound secondary parallel superconductor unit composed of a plurality of superconductor elements arranged parallel in an axial direction of the coil structure, wherein the coil structure is configured to cancel any perpendicular interlinkage magnetic flux acting among various superconductor elements of the secondary parallel superconductor unit by the distribution of the magnetic field generated by the superconducting coil.

12. A superconducting coil according to claim 11, wherein each of the superconductor elements comprises a substrate and a superconductor layer formed on the substrate, electrically separated into a plurality of superconductors and arranged in parallel.

13. A superconducting coil according to claim 12, wherein each of the superconductor elements further includes an intermediate layer for electric insulation formed between the substrate and the superconductor layer.

14. A superconducting coil according to claim 13, wherein each of the superconductor elements further includes a metal layer formed on the superconductor layer, the metal layer being electrically separated and arranged in parallel.

* * * * *